United States Patent [19]

Svensson et al.

[11] 4,093,449

[45] June 6, 1978

[54] PHOSPHORUS STEEL POWDER AND A METHOD OF MANUFACTURING THE SAME

[75] Inventors: Lars-Erik Svensson, Hogans; Jan Robert Tengzelius, Viken; Per Folke Lindskog, Hoganas, all of Sweden

[73] Assignee: Hoganas AB, Fack, Hoganas, Sweden

[21] Appl. No.: 735,207

[22] Filed: Oct. 26, 1976

[51] Int. Cl.[2] ..... B22F 1/00

[52] U.S. Cl. ..... 75/0.5 R; 75/0.5 AA; 75/0.5 BA; 75/251; 75/252

[58] Field of Search ..... 75/0.5 BA, 0.5 AA, 0.5 R, 75/251, 252

[56] References Cited

U.S. PATENT DOCUMENTS

| | | | |
|---|---|---|---|
| 3,357,817 | 12/1967 | Harnisch et al. | 75/0.5 BA |
| 3,836,355 | 9/1974 | Lindskog et al. | 75/0.5 BA |
| 3,839,014 | 10/1974 | Cziska et al. | 75/0.5 BA |

*Primary Examiner*—W. Stallard
*Attorney, Agent, or Firm*—Albert L. Jeffers

[57] ABSTRACT

A phosphorus steel powder for manufacturing sintered details having an extremely small tendency to brittleness ruptures consists of iron or steel powder substantially free from phosphorus, mixed with a phosphorus powder characterized by a maximum particle size of 20 μm, preferably a maximum particle size of 10 μm. The phosphorus content of the ferrophosphorus powder shall exceed 2.8% and in order to reduce the wearing of the tools the phosphorus content shall be less than 17%. If the ferrophosphorus powder is manufactured by grinding piece goods the phosphorus content shall exceed 12% and shall preferably be between 14 and 16%. The phosphorus content of the preferred mixture is between 0.2 and 1.5%. The iron-ferrophosphorus mixture is heated with or without the addition of oil in reducing atmosphere to a temperature of between 650° and 900° C for a period of 15 minutes to 2 hours to improve the protection against segregation.

13 Claims, 4 Drawing Figures

PHOSPHORUS STEEL POWDER AND A METHOD OF MANUFACTURING THE SAME

BACKGROUND OF THE INVENTION

1. FIELD OF THE INVENTION

The present invention relates to phosphorous steel powder mixtures to be used within the powder metallurgy. In addition to iron and phosphorus these powder mixtures can contain other alloying elements common within this technique, such as copper, nickel, molybdenum, chromium and carbon.

2. DESCRIPTION OF THE PRIOR ART

The use of phosphorus as an alloying element within the powder metallurgy has been known since the forties. Sintered steel alloyed with phosphorus has substantially improved strength characteristics in relation to non-alloyed sintered steel. Already at an early date there were for this object used mixtures of pure iron powder and ferrophosphorus powder. However, the ferrophosphorus first used had a composition which made it extremely hard and caused a considerable wearing of the tools. This drawback has been reduced to an acceptable degree by using a ferrophosphorus powder having a lower content of phosphorus and thereby reduced hardness see for example Swedish Pat. No. 372,293.

However, sintered details manufactured by pressing and sintering such steel powder mixtures sometimes have an unacceptable brittleness. This is revealed for example by the fact that a population of sintered test bars made from these mixtures can comprise individuals having extremely reduced mechanical characteristics especially with regard to impact strength and permanent strain after rupture (break elongation). As the advantage of phosphorus alloyed sintered steels is high strength in combination with very good strain characteristics the above brittleness risks are very serious.

Said brittleness risk has shown up to be present when the ferrophosphorus is of such composition that there is established a liquid phase at the sintering temperature. At the usually used sintering temperatures, 1040° C and above that, this fact provides that phosphorus contents of more than 2.8% in the ferrophosphorus give a sintered material having an increased brittleness risk. The fact that ferrophosphorus having a high phosphorus content is used in spite of this drawback is dependent on the favorable sintering process which is provided by the liquid phase and the favorable distribution of the phosphorus in turn providing for a rapid indiffusion thereof which is obtained because of the fact that the ferrophosphorus provides for a liquid phase.

SUMMARY OF THE INVENTION

Thus, the object of the present invention is to solve said problems with regard to the brittleness of sintered steel manufactured from a mixture of iron powder and a ferrophosphorus powder having a phosphorus content exceeding 2.8%. The solution of the problem has proved to reside in the use of a ferrophosphorus powder having a small maximum particle size.

A phosphorus steel powder according to the invention for manufacturing sintered details having an extremely small tendency to brittleness ruptures consists of iron or steel powder substantially free from phosphorus, mixed with a phosphorus powder characterized by a maximum particle size of 20 μm, preferably a maximum particle size of 10 μm. The phosphorus content of the ferrophosphorus powder shall exceed 2.8% and in order to reduce the wearing of the tools the phosphorus content shall be less than 17%. If the ferrophosphorus powder is manufactured by grinding piece goods the phosphorus content shall exceed 12% and shall preferably be between 14 and 16%. The phosphorus content of the preferred mixture is between 0.2 and 1.5%.

In this case there is a great difference between the particle sizes of the powder components in the mixture leading to an especially great risk of segregation and thereby of a discontinuous distribution of the alloying elements. In order to reduce the tendency of the mixture to segregate after the mixing operation 50 – 200 g of a light mineral oil per metric ton powder can be added during the mixing operation. Thereby the fine alloying particles are brought to adhere to the coarser iron powder particles.

In order to improve the protection against segregation the iron-ferrophosphorus mixture is heated with or without the addition of oil in reducing atmosphere to a temperature of between 650° and 900° C for a period of 15 min to 2 hours. Thereby, the powder is loosely sintered together so that a following cautious disintegration has to be carried out in order to restore the original particle size. The powder provided in this way has iron particles with particles of the fine grained ferrophosphorus powder sintered thereto.

The methods described above in order to avoid segregation can be performed to a mixture having an increased content of the phosphorous powder. The concentrate so obtained can be mixed with the iron powder to provide for the desired phosphorus content in the final product.

DESCRIPTION OF THE PREFERRED EMBODIMENTS

The advantage of a powder mixture according to the invention appears from the two following examples.

EXAMPLE 1

Figure 1:
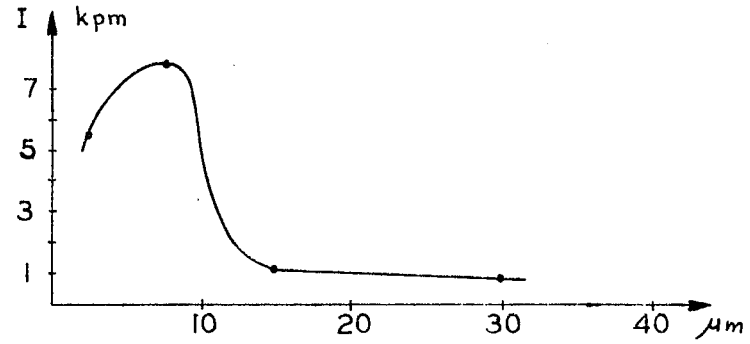
FIG. 1 is a plot of impact strength along the ordinate, vs. particle size of the phosphorus.
Figure 2:
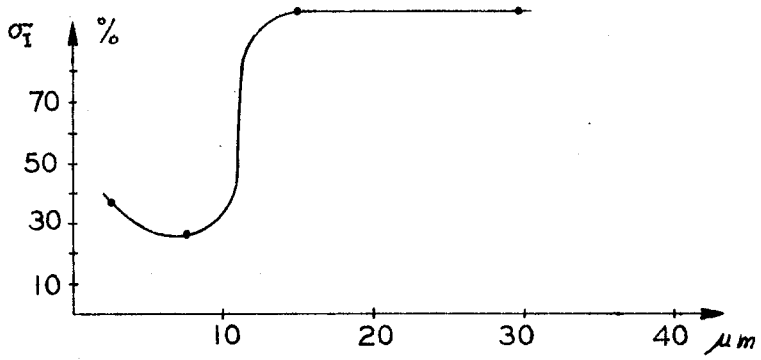
FIG. 2 is a plot of the standard deviation, plotted along the ordinate, for the plot of FIG. 1, vs. particle size of the phosphorus.

A ferrophosphorus powder having a phosphorus content of 15.8 weight-% was divided in the size classes 0–5 μm, 5–10 μm, 10–20 μm and 20–40 μm by means of a wind-sieve device. The different powder fractions were mixed with very pure iron powder having the maximal particle size of 150 μm. The phosphorus content of the mixture was 0.6 weight-% as this content has proved to give a distinct evidence as to the brittleness tendency of sintered materials. Seven impact strength test bars were manufactured from each mixture at 588 MPa. They were sintered in cracked ammonia at 1120° C for 60 minutes. The bars were not impaired by any indications of fracture and were treated in a Charpy-apparatus at room temperature. The mean value of the impact strength (I) of these seven bars as a function of the particle size of the phosphorus is shown in FIG. 1. The standard deviation ($\sigma_l$) for the established values is given in FIG. 2.

Example 1 evidently shows that the material manufactured from the mixture having a ferrophosphorus powder particle size of 5 to 10 μm has the greatest toughness. The material having ferrophosphorus particles of greater size than 15 μm does however provide for brittle sintered details.

EXAMPLE 2

Figure 3:
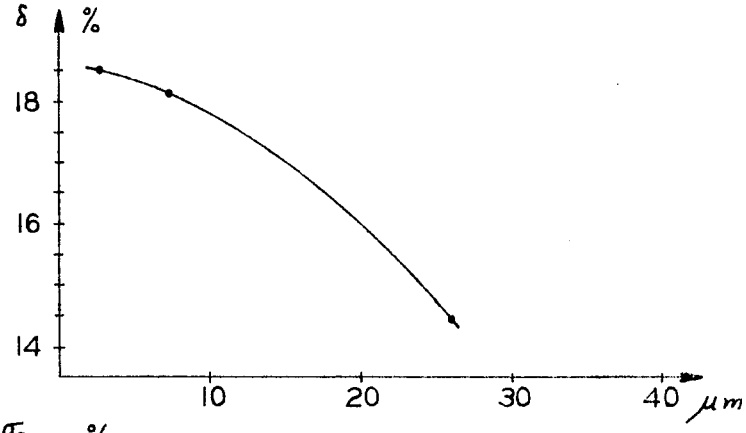
FIG. 3 is a plot of break elongation, plotted along the ordinate, vs. phosphorus particle size.
Figure 4:
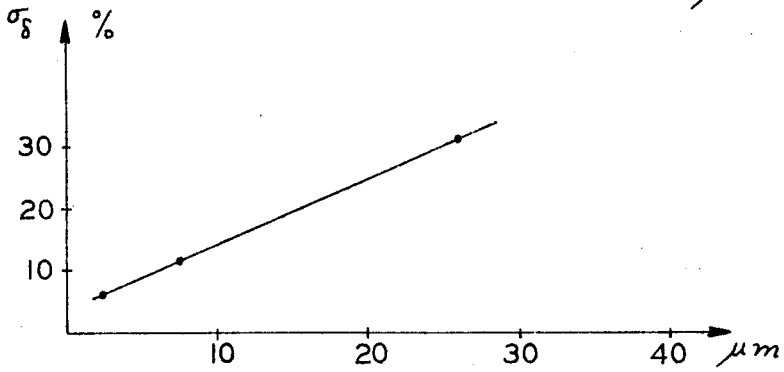
FIG. 4 is a plot of the standard deviation, plotted along the ordinate, for the plot of FIG. 3, vs. phosphorus particle size.

A ferrophorsphorus powder having a phosphorus content of 15.8 weight-% was divided in the size classes 0–5 μm, 5–10 μm and 10–40 μm by means of a wind-sieve device. The different powder fractions were mixed with very pure iron powder having the maximal particle size of 150 μm. The phosphorus content of the mixtures was 0.6 weight-%. Seven tensile test bars were pressed from each mixture at 588 MPa. The bars were sintered in cracked ammonia at 1120° C for 60 minutes. Thereupon the test bars were loaded to break and were then examined with regard to premanent strain after rupture (break elongation) (o), which is a good indication of the toughness of a material. A tough material has a high elongation value while a brittle material has a low elongation value. Furthermore the standard deviation ($\sigma_\delta$) with regard to the elongation values for the seven bars was calculated. A high standard deviation means great deviation of the values while a low standard deviation means a small deviation. The result of the test is shown in FIGS. 3 and 4.

It appears from the above example that a great particle size of the ferrophosphorus provides for a break because of brittleness while a small particle size provides for a break because of insufficient toughness. Both of the two tested characteristics unequivocally indicate this fact.

Thus, the present invention represents a solution of the problems of breaks because of brittleness, which sintered steel manufactured from a mixture of iron powder and ferrophosphorus powder present in certain cases. The solution resides in the use of a ferrophosphorus powder having a particle size less than 20 μm, preferably less than 10 μm. We claim:

1. A phosphorous steel powder for manufacturing sintered mouldings having high toughness and strength, comprising a basic powder of a steel powder substantially free from phosphorus and having good compressibility to which is intimately added a low-temperature-melting ferrophosphorus powder having a phosphorus content of at least 2.8%, in such an amount that the phosphorus content of the mixture is 0.2 to 1.5%, wherein the ferrophosphorus powder has a maximum particle size of 20 μm.

2. A phosphorous steel powder as claimed in claim 1, said powder further comprising 0.005 to 0.02% of a fluent mineral oil for diminishing the risk of segregation.

3. A phosphorous steel powder as claimed in claim 1, wherein the ferrophosphorus particles are by means of sintering substantially adhered to the steel powder particles for obviating segregation.

4. A method of manufacturing a phosphorous steel powder wherein a basic powder of steel powder is intimately mixed with ferrophosphorus powder and the ferrophosphorus particles are adhered to the steel powder particles by adding 0.005 to 0.02% fluent mineral oil.

5. A method as claimed in claim 4, wherein the ferrophosphorus powder is first mixed with a portion of the steel powder to a concentrate with the addition of 0.005 to 0.02% fluent mineral oil and the concentrate is subjected to sintering and disintegration.

6. The powder of claim 1 wherein said ferrophosphorus powder has a phosphorus content between 12 and 17 percent.

7. The powder of claim 1 wherein said ferrophosphorus powder has a maximum particle size of 10 μm.

8. A method of manufacturing a phosphorus steel powder wherein a basic powder of steel powder is intimately mixed with ferrophosphorus powder having a maximum particle size of 20 μm and adhering the ferrophosphorus particles to the steel powder particles by a loose sintering with subsequent cautious disintegration of the cakes thus created.

9. The method of claim 4 wherein the ferrophosphorus particles are adhered to the steel powder particles by a loose sintering with subsequent cautious disintegration of the cakes thus created.

10. The method of claim 5 including the step of adding alloying powder to the steel powder.

11. The method of claim 4 wherein the ferrophosphorus powder has a maximum particle size of 10 μm.

12. A phosphorus steel powder for manufacturing sintered mouldings having high toughness and strength, comprising a basic powder of a steel powder substantially free from phosphorus and having good compressibility to which is intimately added a low-temperature-melting ferrophosphorus powder wherein the ferrophosphorus powder has a maximum particle size of 20 μm.

13. The method of claim 12 wherein said ferrophosphorus powder has a maximum particle size of 10 μm.

* * * * *

UNITED STATES PATENT AND TRADEMARK OFFICE

CERTIFICATE OF CORRECTION

PATENT NO. : 4,093,449

DATED : June 6, 1978

INVENTOR(S) : Lars-Erik Svensson; Jan Robert Tengzelius and Per Folke Lindskog

It is certified that error appears in the above-identified patent and that said Letters Patent are hereby corrected as shown below:

Col. 4, line 12 (claim 4) after "powder" the following insertion omitted, --having a maxium particle size of 20 um--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*